US007429225B1

(12) United States Patent
Shull

(10) Patent No.: US 7,429,225 B1
(45) Date of Patent: Sep. 30, 2008

(54) TENNIS NET LIFTER SYSTEM AND ASSOCIATED METHOD

(76) Inventor: James Shull, 14635 N. 400 West, Silver Lake, IN (US) 46982

( * ) Notice: Subject to any disclaimer, the term of this patent is extended or adjusted under 35 U.S.C. 154(b) by 103 days.

(21) Appl. No.: 11/481,538

(22) Filed: Jul. 7, 2006

(51) Int. Cl.
*A63B 61/04* (2006.01)
*A63B 69/38* (2006.01)

(52) U.S. Cl. ..... 473/494; 473/490; 473/459; 473/474

(58) Field of Classification Search ..... 473/490, 473/492–494, 459, 462, 473, 474
See application file for complete search history.

(56) References Cited

U.S. PATENT DOCUMENTS 3,993,306 A 11/1976 Scott
4,116,437 A 9/1978 Johnson
4,204,679 A * 5/1980 Kreuzman ..... 473/462
4,231,572 A 11/1980 Thornton
4,243,221 A * 1/1981 Ferreira-Godinho ..... 473/432
4,309,032 A 1/1982 Facius
4,436,304 A * 3/1984 Castleman et al. ..... 473/462
4,696,471 A 9/1987 McGrath et al.
4,796,886 A 1/1989 Loh
4,852,876 A * 8/1989 Scioscia ..... 473/459
4,911,442 A 3/1990 Monroe et al.
5,472,212 A * 12/1995 Bercaw ..... 473/462
5,692,978 A * 12/1997 Hummel ..... 473/459
5,709,620 A 1/1998 Reinprecht
5,827,137 A * 10/1998 Ishino ..... 473/459
6,802,789 B1 * 10/2004 Ishino ..... 473/459
7,056,241 B1 * 6/2006 Ishino ..... 473/459

* cited by examiner

*Primary Examiner*—Raleigh W. Chiu

(57) ABSTRACT

A tennis net lifter system includes first and second portable lifter posts positioned adjacent to existing tennis net anchor posts in various positions. A mechanism is included for connecting the lifter posts to the anchor posts. A mechanism is included for telescopically locking the lifter posts at selected heights above the anchor posts. A mechanism is included for raising and lowering the lifter net section along a vertical plane aligned parallel with the existing net such that the player can uniformly bias the lifter net section along a width of the tennis court. In addition to providing at least four alternate net section embodiments, the present invention further includes a portable dolly and a hand-operable winding apparatus for storing and transporting the net sections, respectively.

18 Claims, 11 Drawing Sheets

TENNIS NET LIFTER SYSTEM AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to lifting systems and, more particularly, to a tennis net lifer system and associated method for assisting a tennis player to practice various skills-improvement tests.

2. Prior Art

Speed, strength, and agility are important in tennis. But skillful ball placement provides a significant competitive edge that is often more readily attained, and many practice aids and coaching theories strive to develop this skill. The notable technique of visualizing a target along the tennis net is particularly effective. Rather than aiming directly at the far court where the ball is to be placed, attention is directed to a spot along the net, and the ball is hit over the net at the selected spot. When guided in this manner, more consistent ball placement tends to result.

A number of devices have been proposed in the past for aiding the training of tennis players. Most of these devices have attempted to provide means for improving the accuracy of tennis shots so that the player can become more accomplished and adept at their sport, and a wide variety of different devices have been suggested. For example, many of the tennis practice devices heretofore proposed have been of the rebound variety wherein an upright wall surface or the like is provided which presents a target for the player. Tennis balls shot against the wall surface rebound back towards the player and land on a previously marked foreground which determines whether the ball would have alighted within an imaginary court beyond the wall surface.

Another type of tennis target structure provides an upright net or canvas barriers having a tennis ball-clearing opening therein with ball-catching means in the form of net or the like immediately therebehind. In these types of devices the player attempts to shoot tennis balls into the opening which is purportedly positioned so that a successful shot would land in the playing area of an actual tennis court. One prior art example shows an upright net structure with openings therein which is adapted to be situated within a practice area. Good tennis shots which would fall within the playing area of an actual tennis court are supposed to pass through the openings and are held within the pockets therebehind. Another prior art example discloses a number of flexible flaps that cover the ball-clearing opening of the unit which are supposed to signify when hit by a tennis ball that the shot would have landed within a given area of an imaginary court therebeyond.

While some of the above described tennis target structures have achieved a certain degree of acceptance they nevertheless have been plagued by a number of deficiencies. The most persistent objection to these devices is that they create an unnatural practice situation for the player. That is, these units are not usable in conjunction with a regulation tennis court so that anyone using the same looses the feel of actual court conditions. Furthermore, the lack of adjustability in many of these units precludes the possibility that various specialized types of shots can be practiced. For example, while a given target device may permit practice on certain types of serves, it may not be properly dimensioned for the practice of overhand-spin serves or the like since such shots may have very different flight patterns as compared with other styles of serving.

Furthermore, ground strokes such as forehands and backhands cannot successfully be practiced on fixed-dimension target structures since these shots characteristically have a much greater arc than serves and are shot from a position much closer to the playing surface. The problems noted above are of course accentuated when different players attempt to use a single target structure at different times. For example, a tall player who desires to practice serves having a high degree of top spin may require a target structure of certain dimensions, while a shorter player wishing to practice high-arc ground strokes would need a differently dimensioned target.

Accordingly, a need remains for a tennis net lifer system and associated method in order to overcome the above-noted shortcomings. The present invention satisfies such a need by providing a system that is convenient and easy to use, is durable in design, is easily adaptable and versatile in nature, and provides the user with a dynamic training tool. Such a system allows one or more tennis players to practice on an actual court, thus ensuring that game situations will not present them with scenarios that were not encountered during practice. Furthermore, the present system allows a player to practice a variety of different shots. Since the system is easy to use players of all skill level can advantageously benefit therefrom.

BRIEF SUMMARY OF THE INVENTION

In view of the foregoing background, it is therefore an object of the present invention to provide a tennis net lifter system and associated method. These and other objects, features, and advantages of the invention are provided by a tennis net lifter system for assisting a player to practice various skills-improvement tests.

The tennis net lifter system includes first and second upstanding portable lifter posts positioned adjacent to stationary anchor posts of an existing tennis net assembly stretching across a width of a tennis court. Such first and second lifter posts are registered parallel to the anchor posts and travel along entire longitudinal lengths thereof respectively. Each of the lifter posts preferably includes a male body and a female body that are slidably engageable with each other. The female body has a hollow center and remains statically positioned directly on the ground surface while the male body is telescopically biased along a longitudinal length of the female body. Each of the male and female bodies has corresponding apertures formed therein that are equidistantly spaced apart.

A mechanism is included for connecting the first and second lifter posts to the anchor posts such that the first and second lifter posts remain at substantially stable and vertical positions during playing conditions. Such a first and second lifter post connecting mechanism preferably includes a plurality of bracket pairs that have first and second arcuate regions seated about an outer periphery of the anchor posts, and the first and second lifter posts respectively. Each of the bracket pairs is oppositely and diametrically opposed on opposite sides of the anchor posts and the first and second lifter posts respectively such that corresponding ones of the brackets pairs are directly fastened to each other and thereby effectively maintain a static spatial relationship between the anchor posts and the first and second lifter posts respectively.

In an alternate embodiment of the system, the first and second lifter post connecting mechanism may include a plurality of interlocking brackets that have male and female portions monolithically formed with the first and second lifter posts and anchor posts respectively. Such male and female portions are statically and directly conjoined for effectively maintaining the anchor posts and the first and second lifter posts equidistantly spaced along the vertical plane. A mechanism is included for telescopically locking the first and second lifter posts at selected heights above the anchor posts respectively. Such a telescopically locking mechanism preferably includes an L-shaped locking pin that is removably positional into corresponding ones of the apertures aligned along a horizontal plane such that the male and female bodies advantageously remain statically fixed when the locking pin is inserted therethrough respectively. Each of the locking pins includes a J-shaped clasp slidably conjoined therewith. Alternately, such clasps may be welded or otherwise statically affixed to the respective locking pins. The system preferably further includes a mechanism for locking the locking pins to the lifter posts respectively. Such a locking pin locking mechanism includes a padlock positioned through one of the locking pins.

A lifter net section is operably coupled to the first and second lifter posts and positioned adjacent to an existing net of the tennis net assembly. Such a lifter net section preferably includes one of the following bodies selected from the group including a mesh screen, a planar screen, a linear headband and a plain cable, for example. The mesh screen has coextensively shaped linear top and bottom edges that span parallel to the existing net. Such a mesh screen has a netted body spanning between entire longitudinal lengths of the top and bottom edges such that the player can effectively maintain a clear line of sight through the mesh screen.

The planar screen has coextensively shaped linear top and bottom edges that span parallel to the existing net. Such a planar screen has a uniformly thick opaque body spanning between entire longitudinal lengths of the top and bottom edges such that the player cannot maintain a clear line of sight through the planar screen. The linear headband has a longitudinal length spanning across the entire width of the tennis court. Such a headband is vertically spaced from the existing net such that a gap is effectively formed between a top edge of the existing net and the headband respectively. Alternately, as described hereinbelow, a unitary and vinyl-coated cable may be employed without the need for the mesh or planar screens.

The lifter net section raising and lowering mechanism may also include a plurality of guides, such as conventional pulleys, that are directly coupled to top ends of the lifter posts respectively. A plurality of elastic and deformably resilient fasteners are directly coupled to the first and second lifter posts and the lifter net section respectively. A hand-operable winch is anchored to the first lifter post. A flexible cable that has a fixed longitudinal length is tethered to the winch and one of the locking pins respectively. The cable travels upwardly along an inclined path and is directed over one of the guides whereat the cable turns to a horizontal path and is intercalated along the lifter net section. Such a cable travels along an entire longitudinal length of the lifter net section and thereafter travels downwardly along a declining path wherein the cable terminates at the one locking pin. The cable is anchored to a corresponding one of the J-shaped clasps such that a tension in the cable can advantageously and effectively be manually adjusted by the winch.

The system preferably further includes a plurality of rectilinear rods vertically aligned along a longitudinal length of the lifter net section. Each of the rods is orthogonally registered to a ground surface and is removably affixed to the existing net. Each of the rods includes a C-shaped locking clasp attached approximately midway of a longitudinal length thereof. Such C-shaped locking clasps are directly abutted with the lifter net section in such a manner that the rods can advantageously and effectively withstand lateral external forces from a tennis ball during playing conditions. The C-shaped clasps are slidably positional along the width of the existing tennis net such that the rods can conveniently be equidistantly juxtaposed side-by-side as desired by the player.

A mechanism is included for selectively raising and lowering the lifter net section along a vertical plane aligned parallel with the existing net such that the player can effectively vertically and uniformly bias the lifter net section along the entire width of the tennis court. Such a lifter net section raising and lowering mechanism is spaced from the existing anchor posts. The existing net remains stationary while the lifter net section is selectively raised and lowered along the vertical plane.

In yet another embodiment of the present invention, the system may further include a portable dolly for conveniently winding and storing the lifter net section during non-playing and transport conditions. Such a portable dolly includes a base member including first and second pairs of casters rotatably secured thereto and equidistantly offset from a center of the base member such that the base member can be tilted about one of the first and second caster pairs during transport. An elongated and rectilinear central shaft has a bottom end directly connected to the base member and extends vertically upward therefrom.

A turn-table is rotatably and concentrically journaled about the central shaft. Such a turn-table is disposed above the base member. First and second annular flanges are seated above the turn-table and are statically coupled to the central shaft. The first and second flanges are vertically stacked along a bottom end of the central shaft. A cylindrical spool is journaled about the central shaft and is rotatable in sync with the turn-table. Such a spool has at least one connector pin passing therethrough for effectively latching onto the lifter net section during winding and unwinding operations. A third annular flange is statically coupled to the central shaft and is axially aligned from the first and second flanges. A handle is directly linked to the central shaft. Such a handle protrudes vertically upward from the third flange.

In a further embodiment of the present invention, the system preferably includes a hand-operable winding apparatus for effectively winding and unwinding the headband during non-operating and operating conditions. Such a winding apparatus includes an L-shaped handle, a linear central shaft threadably or otherwise statically connected to the handle, and a pair of disc-shaped flanges journaled about the central shaft. The winding apparatus further includes an auxiliary handle statically coupled directly to one of the disc-shaped flanges and a spool concentrically fastened to the central shaft such that the spool effectively rotates in sync with the central shaft. The handle is removably attached to the central shaft. The spool includes at least one latching pin affixed thereto for conveniently catching the headband during winding and unwinding operations.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
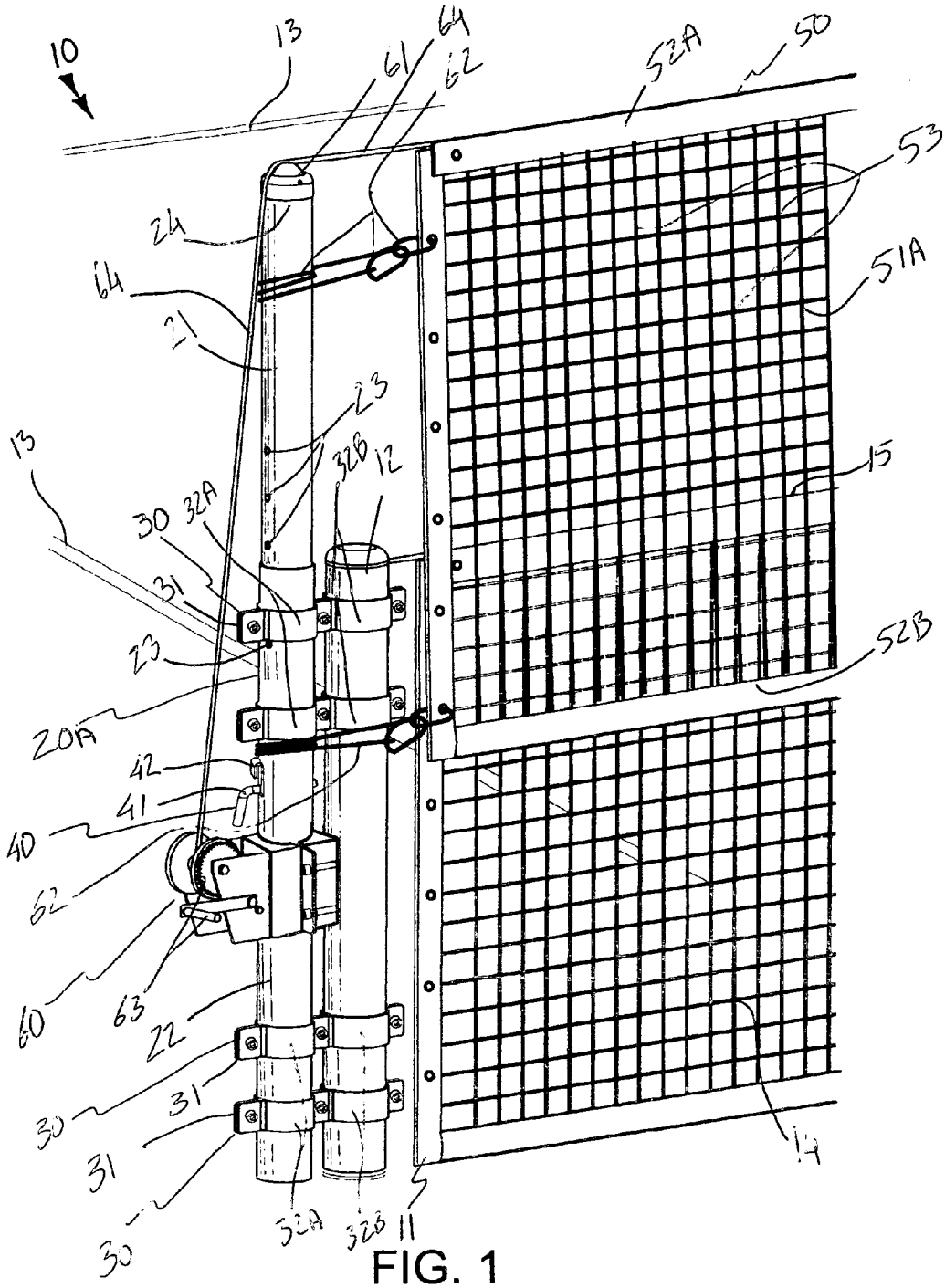
FIG. 1 is a perspective view showing a tennis net lifter system and associated method, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime, double prime, and triple prime number refer to alternate embodiments of such elements.

The system of this invention is referred to generally in FIGS. 1-12 by the reference numeral 10 and is intended to provide a tennis net lifter system and associated method. It should be understood that the system 10 may be used to adjust many different types of nets and should not be limited in use to only raising and lowering tennis nets.

Referring initially to FIGS. 1, 2, 3, 4, 5, 12, the system 10 includes first 20A and second 20B upstanding portable lifter posts 20 positioned adjacent to, but not necessarily in line with the existing tennis net assembly, stationary anchor posts 12 of an existing tennis net assembly 11 stretching across a width of a tennis court 13. Such first 20A and second 20B lifter posts are registered parallel to the anchor posts 12 and travel along entire longitudinal lengths thereof respectively. Each of the lifter posts 20 includes a male body 21 and a female body 22 that are slidably engageable with each other. The female body 22 has a hollow center and remains statically positioned directly, without the use of intervening elements, on the ground surface while the male body 21 is telescopically biased along a longitudinal length of the female body 22. Each of the male 21 and female 22 bodies has corresponding apertures 23 formed therein that are equidistantly spaced apart.

Referring to FIGS. 1, 2, 4 and 5, a mechanism 30 is included for connecting the first 20A and second 20B lifter posts to the anchor posts 12, which is essential such that the first 20A and second 20B lifter posts remain at substantially stable and vertical positions during playing conditions. Such a first and second lifter post connecting mechanism 30 includes a plurality of bracket pairs 31 that have first 32A and second 32B arcuate regions seated about an outer periphery of the anchor posts 12, and the first 20A and second 20B lifter posts respectively. Each of the bracket pairs 31 is oppositely and diametrically opposed on opposite sides of the anchor posts 12, and the first 20A and second 20B lifter posts respectively such that corresponding ones of the brackets pairs 31 are directly fastened, without the use of intervening elements, to each other and thereby effectively maintain a static spatial relationship between the anchor posts 12 and the first 20A and second 20B lifter posts respectively.

Figure 12:
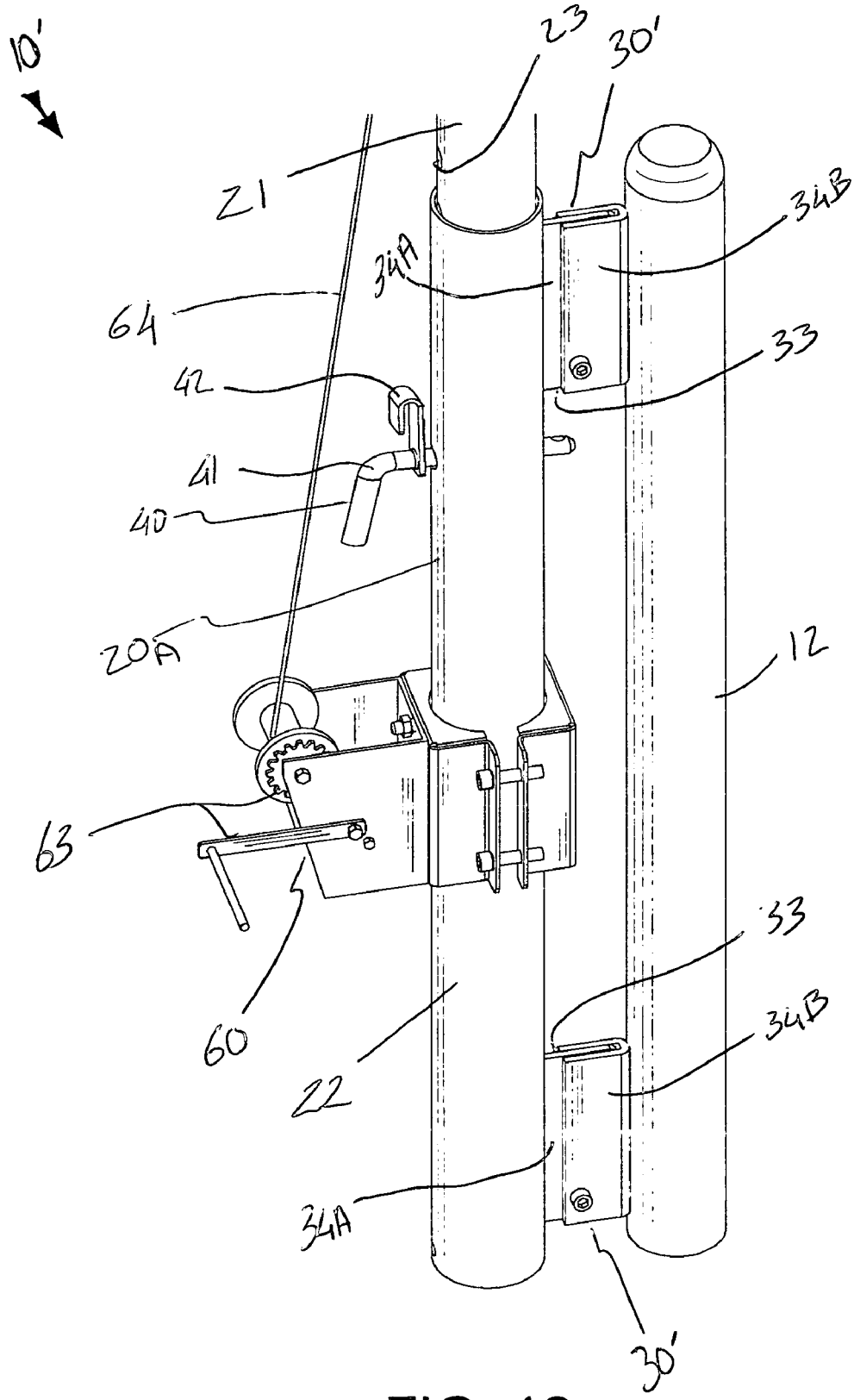
FIG. 12 is a perspective view showing an alternate embodiment of the first and second lifter post connecting mechanism, in accordance with the present invention.

Referring to FIG. 12, in an alternate embodiment 10' of the system, the first and second lifter post connecting mechanism 30' includes a plurality of interlocking brackets 33 that have male 34A and female 34B portions monolithically formed with the first 20A and second 20B lifter posts, and the anchor posts 12 respectively. Such male 34A and female 34B portions are statically and directly conjoined, without the use of intervening elements, which is crucial for effectively maintaining the anchor posts 12 and the first 20A and second 20B lifter posts equidistantly spaced along the vertical plane.

Referring to FIGS. 1, 2, 3, 4, 5 and 12, a mechanism 40 is included for telescopically locking the first 20A and second 20B lifter posts at selected heights above the anchor posts 12 respectively. Such a telescopically locking mechanism 40 includes L-shaped locking pins 41 that are removably positional into corresponding ones of the apertures 23 aligned along a horizontal plane, which is vital such that the male 21 and female 22 bodies advantageously remain statically fixed when a locking pin 41 is inserted therethrough respectively. Each of the locking pins 41 includes a J-shaped clasp 42 slidably conjoined therewith. Alternately, such clasps may be welded or otherwise statically affixed to the respective locking pins. The system 10 further includes a mechanism 43 for locking the locking pins 41 to the lifter posts 20 respectively. Such a locking pin locking mechanism 43 includes a padlock 44 positioned through one 41A of the locking pins 41. Of course, other types of locks 44 may be employed by the locking mechanism, like a combination lock, as is obvious to a person of ordinary skill in the art.

Figure 4:
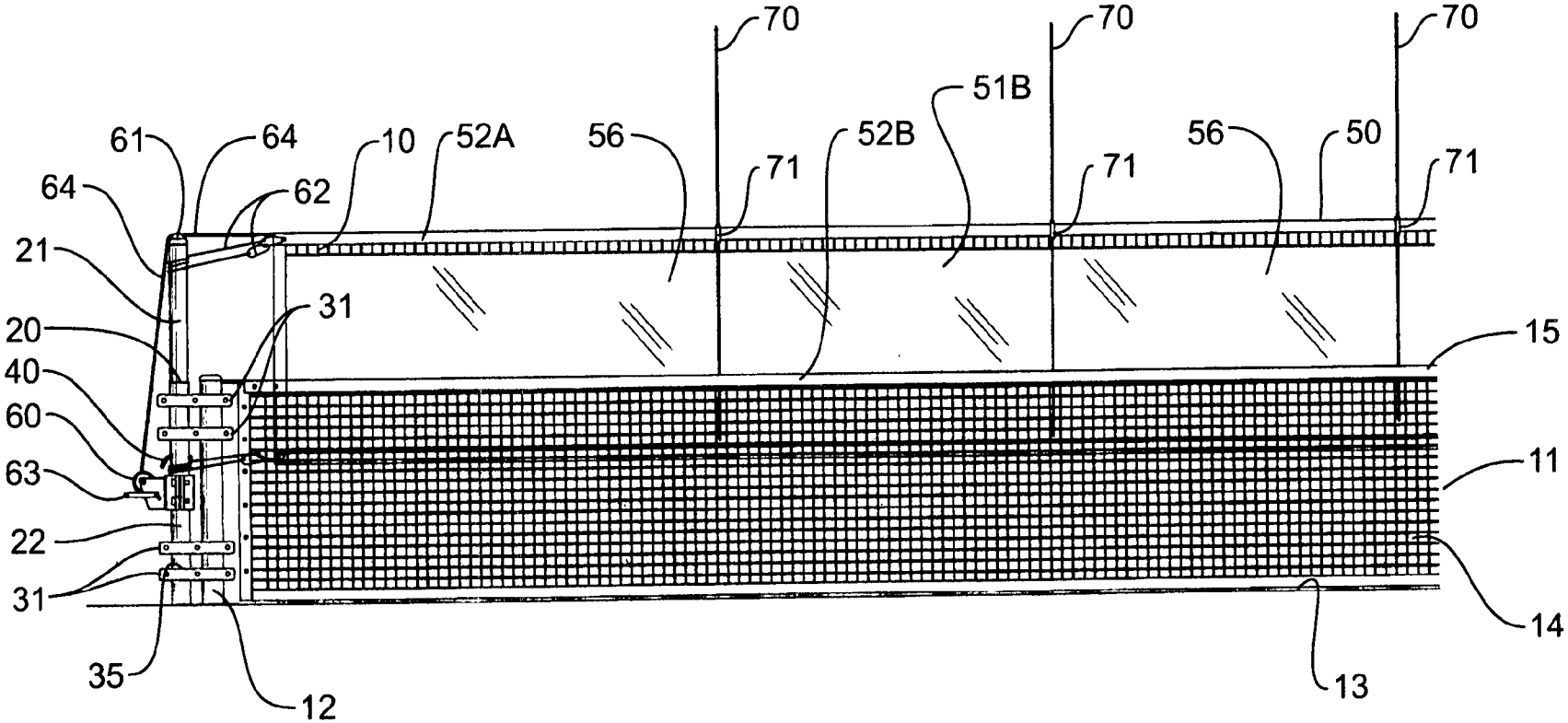
FIG. 4 is a front-elevational view of the system shown in FIG. 1, showing the first lifter post provided with a single band of netting connected directly therebeneath.
Figure 5:
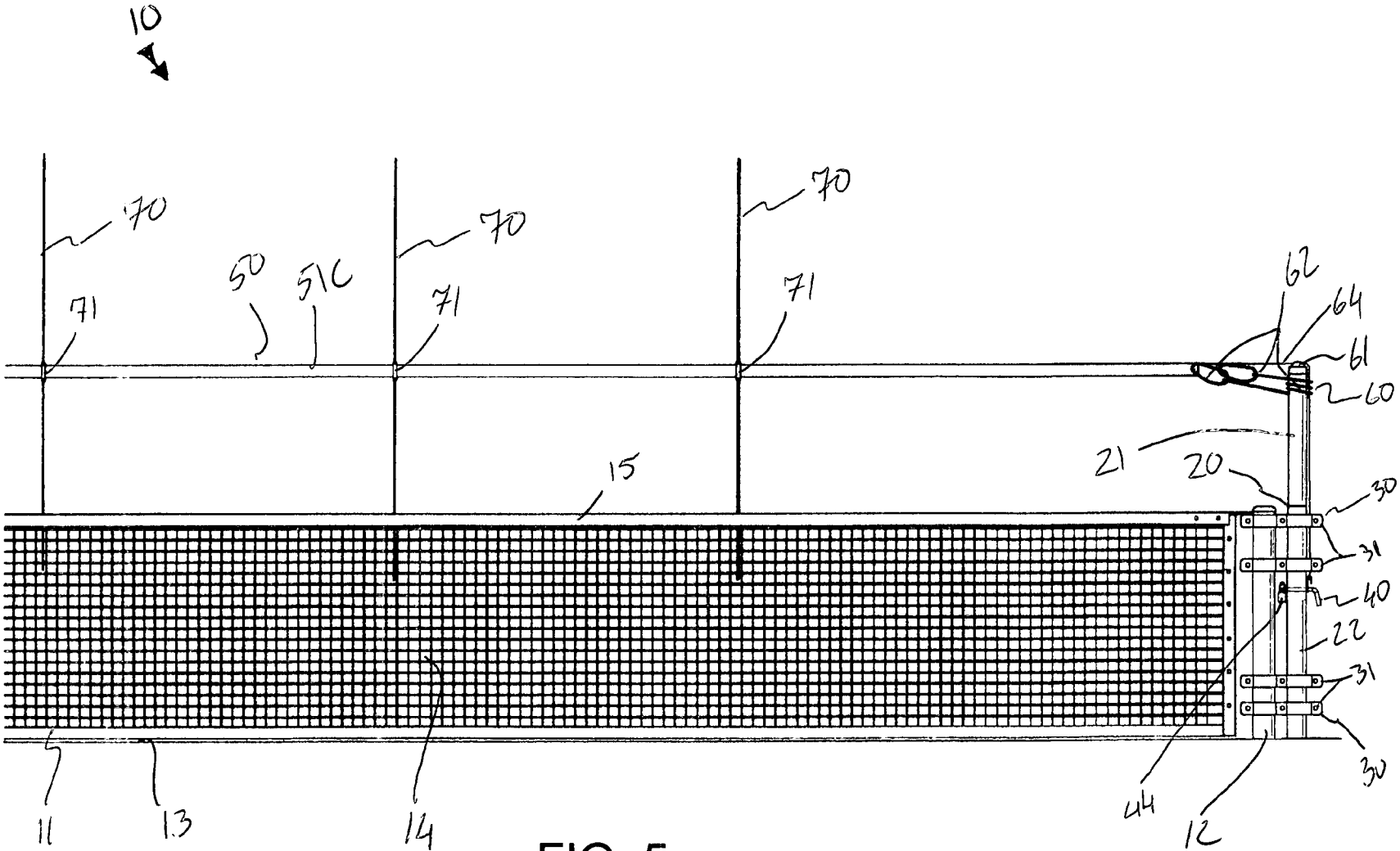
FIG. 5 is a front-elevational view of the system shown in FIG. 1, showing the second lifter post.

Referring to FIGS. 1, 4 and 5, a lifter net section 50 is operably coupled to the first 20A and second 20B lifter posts and positioned adjacent to an existing net 14 of the tennis net assembly 11. Such a lifter net section 50 includes one of the following bodies 51 selected from the group including a mesh screen 51A, a planar screen 51B, a linear headband 51C and a plain cable, for example. The mesh screen 51A has coextensively shaped linear top 52A and bottom 52B edges that span parallel to the existing net 14, as is best shown in FIG. 1. Such a mesh screen 51A has a netted body 53 spanning between entire longitudinal lengths of the top 52A and bottom 52B edges such that the player can effectively maintain a clear line of sight through the mesh screen 51A.

The planar screen 51B has coextensively shaped linear top 52A and bottom 52B edges that span parallel to the existing net 14, as is best shown in FIG. 4. A thin, netted and mesh-like band is directly coupled to the top edge 52A for slidably receiving the C-clamps (described hereinbelow). Such a planar screen 51B has a uniformly thick opaque body 54 spanning between entire longitudinal lengths of the top 52A and bottom 52B edges such that the player cannot maintain a clear line of sight through the planar screen 51B. The linear headband 51C has a longitudinal length spanning across the entire width of the tennis court 13. Such a headband 51C is vertically spaced from the existing net 14, which is critical such that a gap is effectively formed between a top edge 15 of the existing net 14 and the headband 51C respectively. Such an embodiment of the screen may be opaque, transparent or semi-transparent such that the line of sight from one end of the tennis court to the opposite end can be modified, as desired by the players.

A further embodiment of the headband 51 preferably includes a vinyl coated cable stretching across the width of the tennis court. Such an embodiment is spaced from the existing net 11 and does not include a mesh body. Of course, the cable may be formed from any suitable non-corrosive material that is coated with a protective sleeve, as well known to one skilled in the art. In such an embodiment, the unitary and vinyl-coated cable may be employed without the need for the mesh or planar screens.

Referring to FIGS. 1, 2, 3, 4, 5 and 12, a mechanism 60 is included for selectively raising and lowering the lifter net section 50 along a vertical plane aligned parallel with the existing net 14, which is important such that the player can effectively vertically and uniformly bias the lifter net section 50 along the entire width of the tennis court 13. Such a lifter net section raising and lowering mechanism 60 is spaced from the existing anchor posts 12. The existing net 14 remains stationary while the lifter net section 50 is selectively raised and lowered along the vertical plane.

Figure 2:
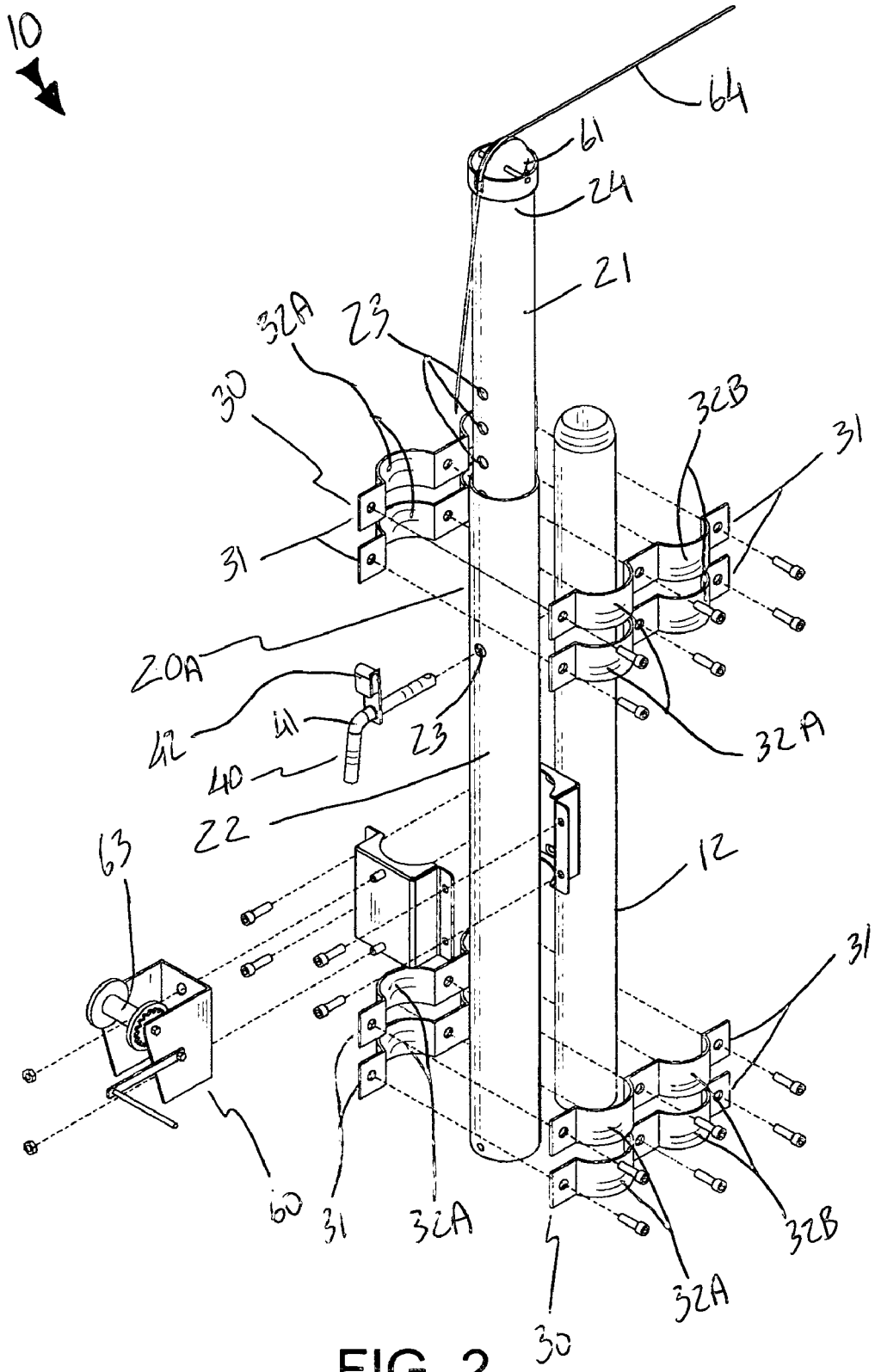
FIG. 2 is an exploded perspective view of the system shown in FIG. 1.
Figure 3:
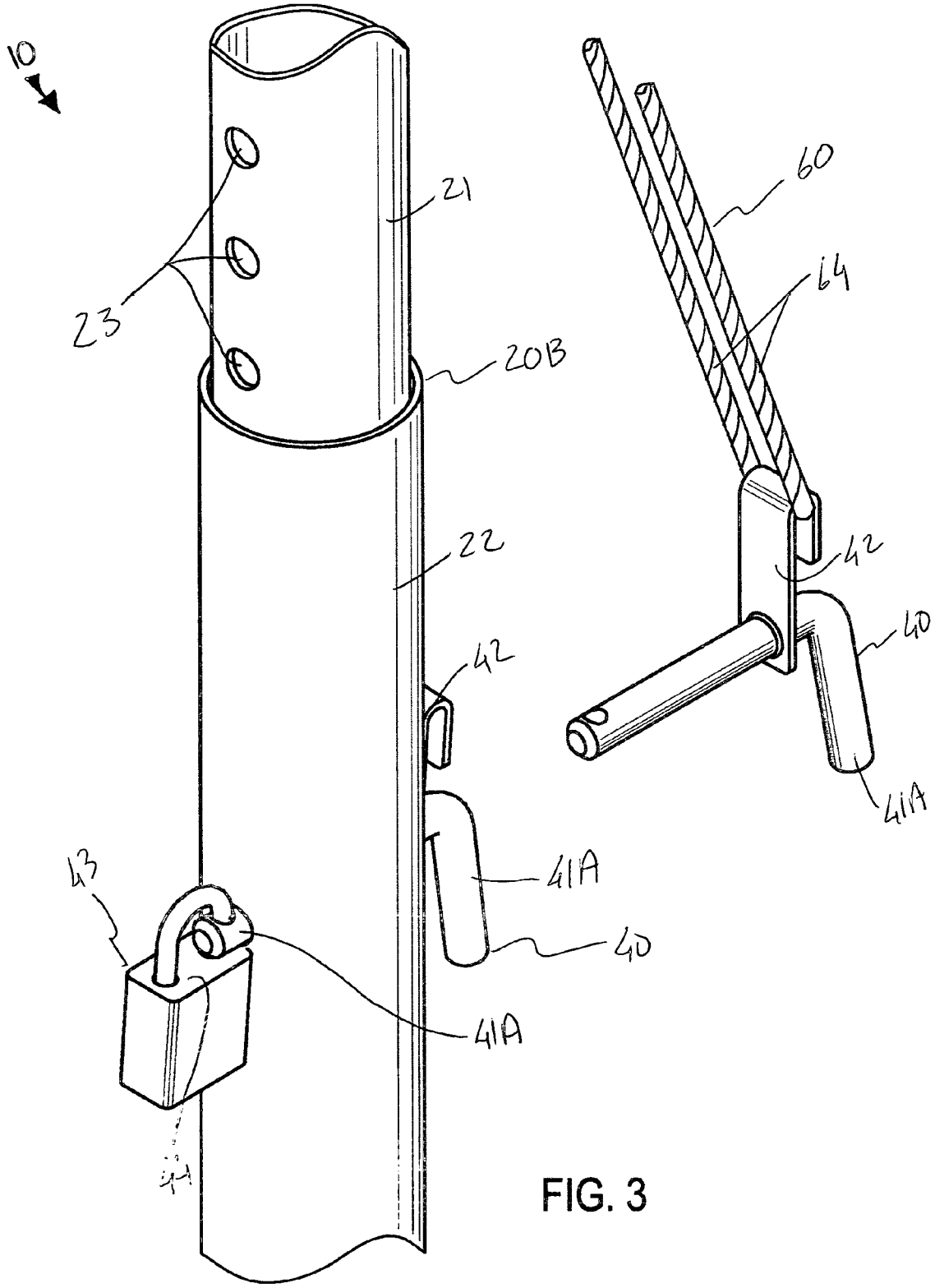
FIG. 3 is an enlarged perspective view of the lifter post shown in FIG. 1.

Still referring to FIGS. 1, 2, 3, 4, 5 and 12, the lifter net section raising and lowering mechanism 60 includes a plurality of guides 61, such as conventional pulleys, that are directly coupled, without the use of intervening elements, to top ends 24 of the lifter posts 20 respectively. It is noted that guides 61 may include conventional pulleys or other similar guides for directing cable 64 from one end of the tennis court to an opposite end thereof. A plurality of elastic and deformably resilient fasteners 62 are directly coupled, without the use of intervening elements, to the first 20A and second 20B lifter posts and the lifter net section 50 respectively. A hand-operable winch 63 is anchored to the first lifter post 20A, as is illustrated in FIGS. 1, 2 and 4. A flexible cable 64 that has a fixed longitudinal length is tethered to the winch 63 and one of the locking pins 41A respectively.

The cable 64 travels upwardly along an inclined path and is directed over one of the guides 61 whereat the cable 64 turns to a horizontal path and is intercalated along the lifter net section 50. Such a cable 64 travels along an entire longitudinal length of the lifter net section 50 and thereafter travels downwardly along a declining path wherein the cable 64 terminates at the one locking pin 41A. The cable 64 is anchored to a corresponding one of the J-shaped clasps 42, which is essential such that a tension in the cable 64 can advantageously and effectively be manually adjusted by the winch.

Figure 6:
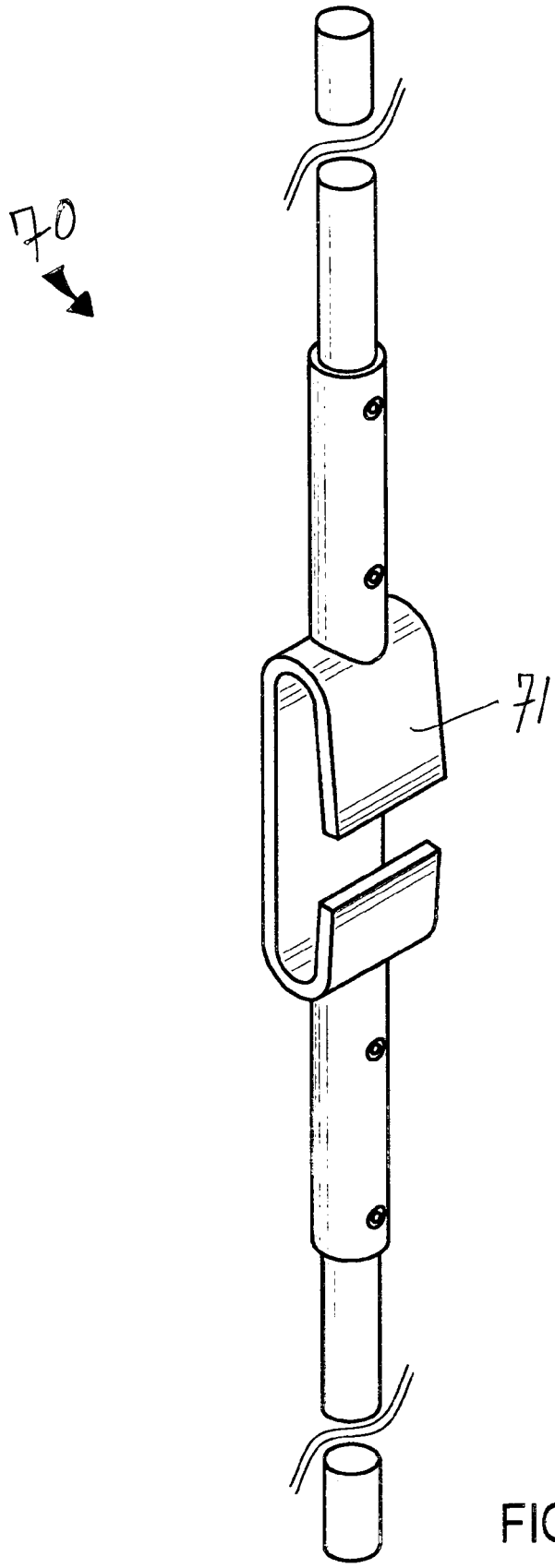
FIG. 6 is an enlarged perspective view of the rods shown in FIGS. 4 and 5.
Figure 7:
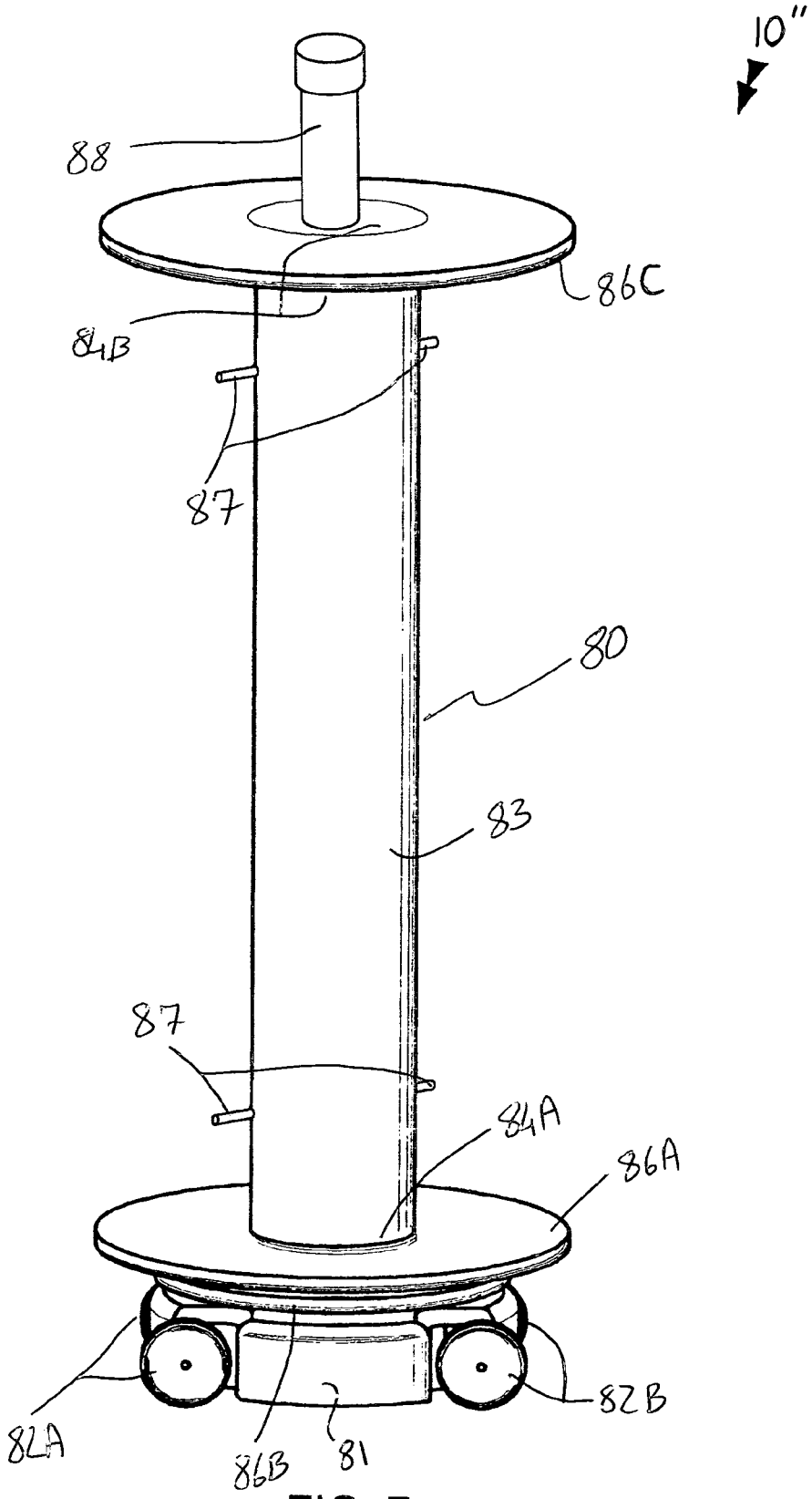
FIG. 7 is a perspective view showing yet another embodiment showing a portable dolly, in accordance with the present invention.
Figure 8:
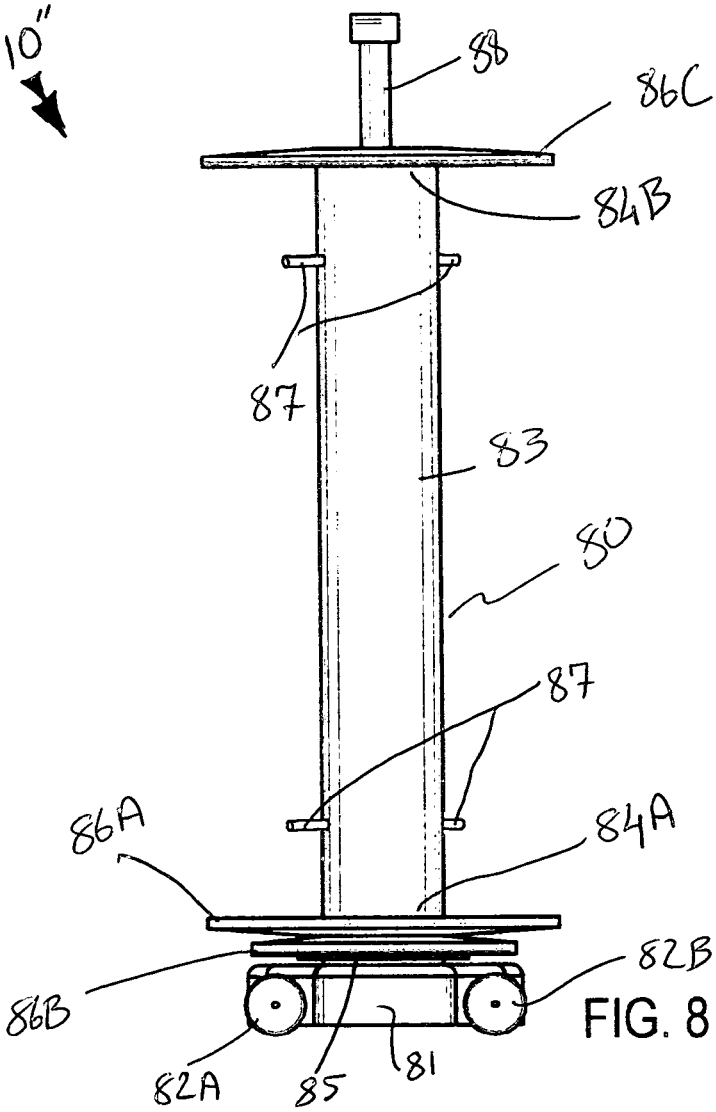
FIG. 8 is a side-elevational view of the portable dolly shown in FIG. 7.
Figure 9:
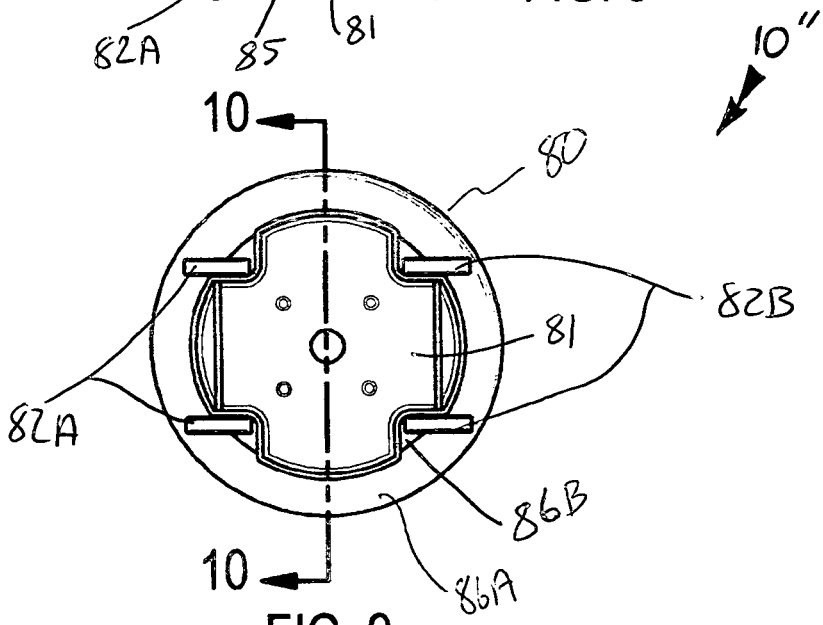
FIG. 9 is a bottom plan view of the portable dolly shown in FIG. 7.
Figure 10:
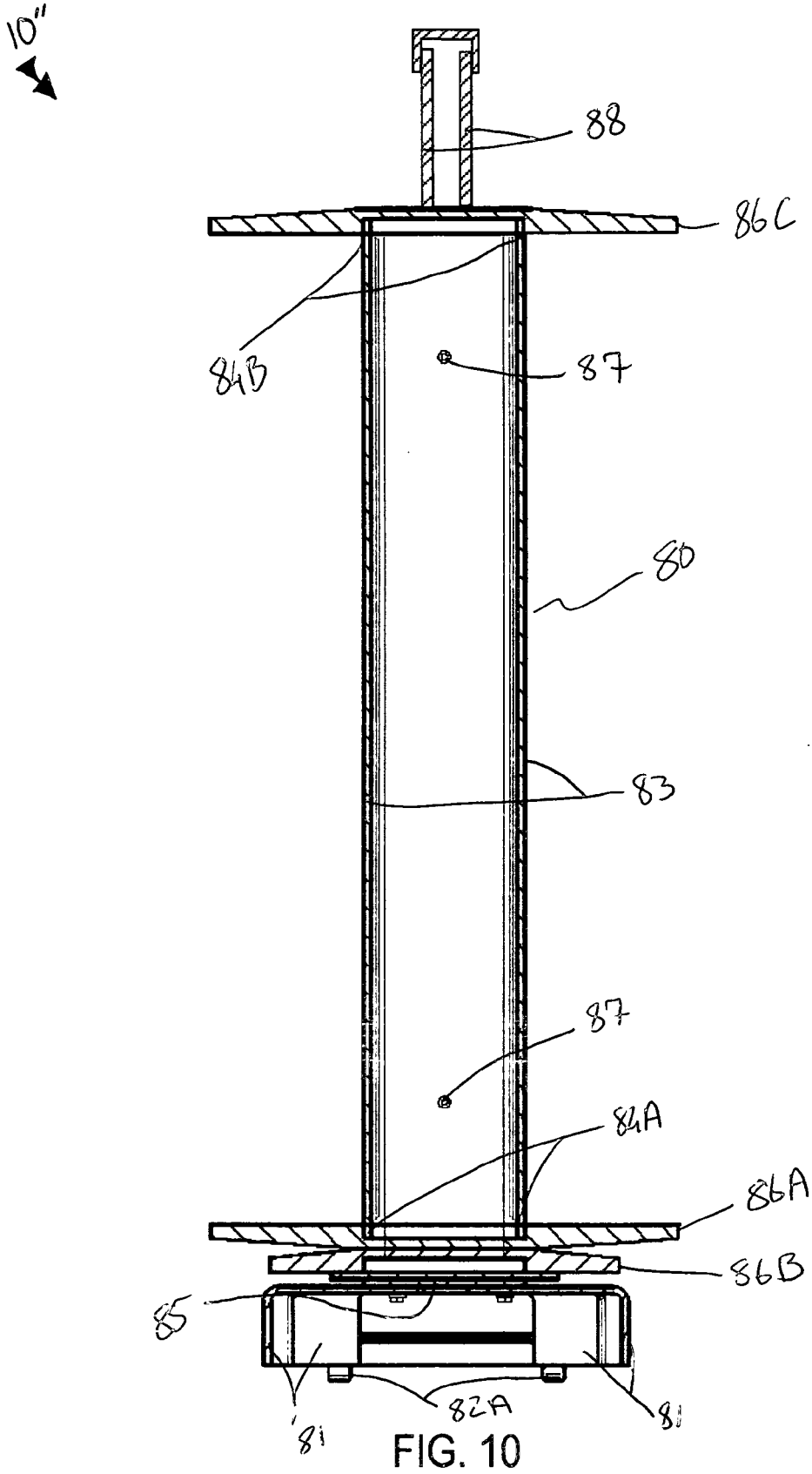
FIG. 10 is a cross-sectional view of the dolly shown in FIG. 9, taken along line 10-10.

Referring to FIGS. 4, 5 and 6, the system 10 further includes a plurality of rectilinear rods 70 that are vertically aligned along a longitudinal length of the lifter net section 50. Each of the rods 70 is orthogonally registered to a ground surface and is removably affixed to the existing tennis net 14 or a top edge 52A of the lifter net section 50. Each of the rods 70 includes a C-shaped locking clasp 71 attached approximately midway of a longitudinal length thereof. Such C-shaped locking clasps 71 are directly abutted, without the use of intervening elements, with the lifter net section 50 and the existing tennis net 14 in such a manner that the rods 70 can advantageously and effectively withstand lateral external forces from a tennis ball (not shown) during playing conditions. The C-shaped clasps 71 are slidably positional along the width of the existing tennis net 14 and the lifter net section 50, which is vital such that the rods 70 can conveniently be equidistantly juxtaposed side-by-side as desired by the player for creating custom target zones.

Referring to FIGS. 7, 8, 9 and 10, in yet another embodiment 10" of the present invention, the system 10" further includes a portable dolly 80 that is essential for conveniently winding and storing the lifter net section 50 during non-playing and transport conditions. Such a portable dolly 80 includes a base member 81 including first 82A and second 82B pairs of casters rotatably secured thereto and equidistantly offset from a center of the base member 81, which is crucial such that the base member 81 can be tilted about one of the first 82A and second 82B caster pairs during transport. An elongated and rectilinear spool 83 has a bottom end 84A directly connected, without the use of intervening elements, to the base member 81 and extends vertically upward therefrom.

A turn-table 85 is rotatably and concentrically and rotatably attached to the second flange 86B (described herein below). Such a turn-table 85 is disposed above the base member 81. First 86A and third 86C (described herein below) annular flanges are seated above the turn-table 85 and are statically coupled to the spool 83. The first 86A and second 86B flanges are vertically stacked along a bottom end 84 of the spool. The cylindrical spool 83 is rotatable in sync with the turn-table 85. Such a spool 83 has at least one connector pin 87 passing therethrough for effectively latching onto the lifter net section 50 during winding and unwinding operations. A third annular flange 86C is statically coupled to top end 84B of the spool 83 and is axially aligned from the first 82A and second 82B flanges. A handle 88 is directly linked to the spool 83. Such a handle 88 protrudes vertically upward from the third flange 86C.

Figure 11:
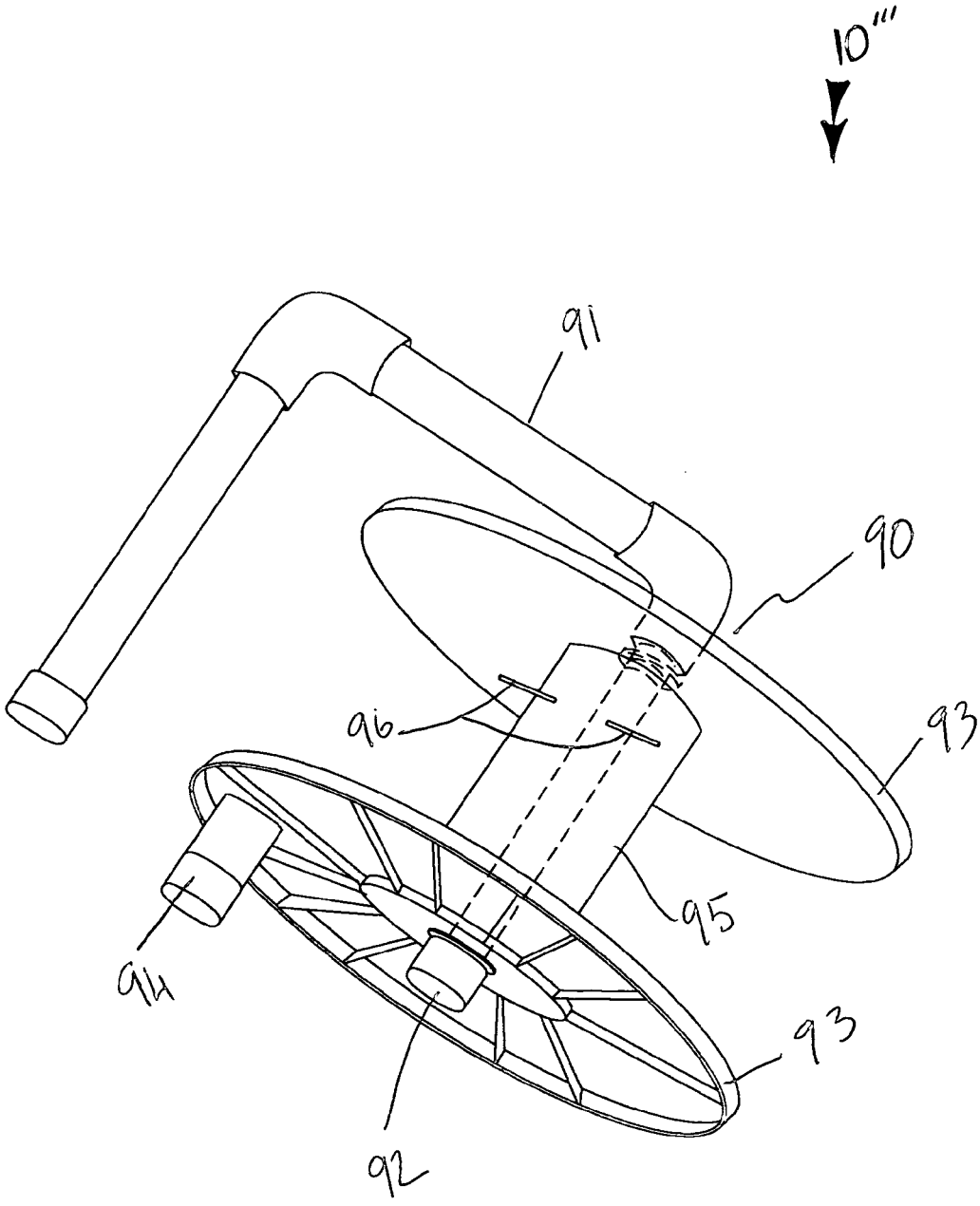
FIG. 11 is a perspective view showing a further embodiment of the present invention, showing a hand-operable winding apparatus, in accordance with the present invention.

Referring to FIG. 11, in a further embodiment 10'" of the present invention, the system 10'" includes a hand-operable winding apparatus 90 for effectively winding and unwinding the headband 51C during non-operating and operating conditions. Such a winding apparatus 90 includes an L-shaped handle 91, a linear central shaft 92 threadably or otherwise statically connected to the reel 91, and a pair of disc-shaped flanges 93 journaled about the central shaft 92. The winding apparatus 90 further includes an auxiliary handle 94 statically, or rotatably, coupled directly, without the use of intervening elements, to one of the disc-shaped flanges 93A and a spool 95 concentrically fastened to the central shaft 92, which is important such that the spool 95 effectively rotates in sync with the central shaft 92. The handle 91 is removably attached to the central shaft 92. The spool 95 includes at least one latching pin 96 affixed thereto that is crucial for conveniently catching the headband 51C during winding and unwinding operations.

Instructions for installing the tennis net lifter system 10 include the following steps. The Tennis Net Lifter can be used on the following posts: Square: 3 inches×3 inches; cylindrical: 2 and ⅞ inch diameter, or 3 inch diameter, or 3 and ½ inch diameter. No other post sizes can be accommodated. Brackets the size you ordered have been included. Three brackets are required, one near the top of the net post and two as near the ground as possible. The farther the top bracket is from the bottom two, the better. If at all possible, the bottom two should be positioned one to two inches apart.

Decide how you will position the lifter posts. The ideal configuration is all four posts (the two tennis net posts plus the two Lifter posts) in a straight line (tandem). If you have external hardware on your tennis posts, consider removing it. However, the Lifter posts can be positioned in any convenient location from the four-in-a-line configuration all the way around until the lifter posts are touching the net inboard from the net posts. Consider putting the post with the lifter reel at the opposite end from the reel already on your court, that is, if your reel is on the west end, put the post with the lifter reel on the east end. Do not remove the reel from the post on which it was shipped! Be sure you note the crank handle position. It must be free to turn once installed.

The Lifter posts are heavy. Do not allow them to injure you or to drop on your court surface and damage it. It is much easier if two people work together. One holds the Lifter post vertical while the other first installs the top bracket. Use the Allen wrench provided to tighten the Allen cap screws only moderately (Don't forget a washer just under the head of each screw). This will allow for final positioning later. Next install the two bottom brackets near each other and near the bottom of the posts. The pulley on each post must be parallel with the net.

The Lifter reel is set in the ideal position at the factory. However, the final position is adjustable. Before tightening all Allen cap screws, inspect your installation to verify all parts are positioned as they should be. Be sure your crank handle is positioned outboard from the net and can be operated freely. The Lifter cable will be reeled in very tightly during use in order to lift the cable nearly parallel to the ground. Consequently, be very sure all Allen cap screws are tight and that you have inspected the installation for safety before use. The Lifter posts need never be moved again. For official matches, they become "permanent fixtures," but remember to lower the Lifter to net height. Note the option to padlock the Lifter to the posts.

To attach the Lifted Net to the Tennis Net Lifter, unroll the net on the court. Lift the net and set the cable over the pulley on the Lifter post which is far away from the Lifter reel. Attach the loop in the cable to the hook provided on the pin which holds the lifted net in position. At the other end, set the break latch on the reel so the cable will not unroll. Next, attach the end to be cranked over the pulley and onto the reel using the projection on the reel. With slight tension, keep the cable engaged to the pulley and tighten the cable. Finally, to keep the newly installed net taught, wrap the bungee cords around the Lifter posts at all four corners. "C-snaps" have been provided along the bottom to keep the net from sailing in windy conditions. Caution: Do not tighten the cable more than is needed as this could damage your posts. Release tension when the Lifter is not in use.

To remove the lifted net, first increase tension on the cable by turning the crank as if to tighten the net. Release the break latch and then slowly lower the net. Caution: Do not let go of the reel handle as it could spin out of control and cause injury. Unwind slowly!

These instructions are for rolling and unrolling the opaque net but the operation is similar for the lifted conventional net. The roll-up procedure is a two-man operation until you have had enough practice to do it alone. For safety reasons, do not leave any net lying on the ground while using another. Roll it up. To roll up the opaque net, stretch out the net on the ground in a straight line. Set the head band to your right as you stand at one short end and face down the length of the net.

Position the Roller on the net about one foot from the end with the dolly wheels to the right (as you face down the length of the net). Engage the bungee cord "pear-snaps" at the corners of the net with the corresponding hooks on the barrel of the Roller. Do not hook the net to the grommets directly as this prevents automatic release when unwinding. Turn the Roller "by hand" two turns making sure the "pear-snaps" stay engaged. Once started, the net will not come off the hooks as you wind it up.

Your helper needs to walk to the far end of the net and pick it up while facing the Roller. You walk to the middle of the net, stand at the side, pick it up, face the Roller, and while walk backward very slowly, "steer" the edges of the net away from the flanges of the roller. Move very slowly! The Roller will move toward you twice as fast as you move and will travel twice as far! Your helper will also back up keeping the net out of your way until the Roller reaches you. When it does, let go of the net and your helper on the far end will complete the process by continuing to slowly back up. With practice, one person can perform the entire operation from the far end or do it in two stages.

When the net is rolled up, it is sometimes useful to tighten the net on the Roller by holding one flange of the Roller so it cannot move and then pulling on the net. The result is a neat, tight package for storage. To tie up the package, tuck in the net cable as you use the bungee cord to go around the net with slight tension. Hook the bungee cord to the netting at the top near the head band. Set the Roller on the dolly end and use the second bungee cord (now in the air) to wrap around the net and hook to the top flange. To cart the Roller across the court, turn the dolly end of the Roller until one set of the dolly wheels is in position on the court surface, tilt the Roller onto the wheels, and go.

To unroll the net, set it on the dolly wheels (and lazy Susan) end of the Roller. Unhook both bungee cords. Have one person hold the handle loosely while a second person holds the net and walks away from the Roller. The net will unwind and detach automatically. It is convenient to parallel the net while unrolling since this will position the net for installation on the Lifter.

Target rod placement instructions are as follows. Placement of two target rods determines each window size above the original net, the lifted net, the opaque net, or the lifted head band. The target rods will arrive partially assembled. The short rod should point up and the long rod should point down; this counterweights the assembly. The opening in the C-hook will ride low when the rod is properly deployed on a net. To complete assembly, tighten all screws firmly.

Determine the window width by standing on the spot where the ball will strike your racket. Look toward the opposite baseline at the sides of the ground target you have chosen. The spots where the lines of sight from the edges of the target cross the net are the places to position the target rods. (For a 6-foot ground target, the window will be 3 to 4 feet wide.) For serves, the window is much smaller because the ground target will likely be much smaller.

Engage the target rod C-hook by hanging it on the net cable. Next, bend the head band and force it through the opening in the C-hook. Note again, the opening of the C-hook should ride low when the target rod is deployed properly. The lower end of each rod can be "tucked" into the original net for stability if you choose. If not, the rods will swivel freely and, being counterweighted, will right themselves if struck by a ball.

Use of the head band includes the following steps. To wind up the Lifted Head Band, attach one end of the cable to the pin on the winder. Wrap the Head Band on to the winder by holding the top handle of the winder with one hand and turn the crank handle with the other hand as you walk toward the far end of the Head Band. Try not to drag the Head Band along the ground as you wind it up as this causes wear. To tighten the wrapping job, if you choose, keep the winder from turning with one hand and with the other, pull to tighten the Head Band on the winder. Continue to wind the extra cable on to the winder. When finished, use the bungee cord to hold the entire job securely by hooking it to any convenient part of the winder.

The system can be applied to any drill you do. The progression you are about to learn involves a major shift in the way you target your shots. Do not aim directly at ground targets. Instead, shift your emphasis to aiming at the properly positioned window in space above the net. When you directly target this window, which is comparatively high, close, and easy to hit, the ball finds the right ground target indirectly. Accuracy is learned faster this way. Drills must be performed frequently and sequentially using the following progression:

Step I: To establish a baseline for comparison, do your chosen drill at normal net height with clear ground targets in place.

Step II: Now begin overloading, that is, become more demanding than in a match. This is done by doing the same drill but with the lifted net (you choose the height) and target rods in place. Again, aim at the window directly and you will hit the ground target indirectly!

Step III: Next, not necessarily on the same day, remove the lifted net and do the same drill with the lifted opaque net and target rods in place. Since the opponent's court with ground targets is invisible now, you will have to aim at windows; nothing else is left to aim at!

Step IV: Remove the lifted opaque net and do the same drill with the raised head band, or bare cable, and target rods in place. Hit above the lifted head band and through the window for depth, but below the raised head band and through the window for short, wide, passing shots, for wide doubles returns of serve, and for doubles volleys.

Step V: Finally, return to step one and do the drill again at normal height without target rods. The drill will feel easy and you will have new insight into targets, trajectories, spin, and pace. It takes repetition to internalize this new mindset, but you will learn shot placement faster when you overload with the Lifter Target System.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A tennis net lifter system for assisting a player to practice various skills-improvement tests, said tennis net lifter system comprising:

first and second upstanding portable lifter posts positioned adjacent to stationary anchor posts of an existing tennis net assembly stretching across a width of a tennis court, said first and second lifter posts being registered parallel to said anchor posts and traveling along entire longitudinal lengths thereof respectively;

means for connecting said first and second lifter posts to said anchor posts such that said first and second lifter posts remain at a substantially stable and vertical positions during playing conditions;

means for telescopically locking said first and second lifter posts at selected heights above said anchor posts respectively;

a lifter net section operably coupled to said first and second lifter posts and positioned adjacent to an existing net of said tennis net assembly; and means for selectively raising and lowering said lifter net section along a vertical plane aligned parallel with said existing net such that the player can vertically and uniformly bias said lifter net section along the entire width of the tennis court;

wherein the existing net remains stationary while said lifter net section is selectively raised and lowered along the vertical plane;

a plurality of rectilinear rods vertically aligned along a longitudinal length of said lifter net section, each of said rods being orthogonally registered to a around surface and being removably affixed to the existing net, each of said rods including a C-shaped locking clasp attached approximately midway a longitudinal length thereof, said C-shaped locking clasps being directly abutted with said lifter net section in such a manner that said rods can withstand lateral external forces from a tennis ball during playing conditions, said C-shaped clasps being slidably positional along the width of the existing tennis net such that said rods can be equidistantly juxtaposed side-by-side as desired by the player.

2. The system of claim 1, wherein said first and second lifter post connecting means comprises:

a plurality of bracket pairs having first and second arcuate regions seated about an outer periphery of said anchor posts and first and second lifter posts respectively, each of said bracket pairs being oppositely and diametrically opposed on opposite sides of said anchor posts and said first and second lifter posts respectively such that corresponding ones of said brackets pairs are directly fastened to each other and thereby maintain a static spatial relationship between said anchor posts and said first and second lifter posts respectively.

3. The system of claim 1, wherein said first and second lifter post connecting means comprises:

a plurality of interlocking brackets having male and female portions monolithically formed with said first and second lifter posts and anchor posts respectively, said male and female portions being statically and directly conjoined for maintaining said anchor posts and said first and second lifter posts equidistantly spaced along the vertical plane.

4. The system of claim 1, wherein each of said lifter posts comprises:

a male body and a female body slidably engageable with each other, said female body having a hollow center and remaining statically positioned directly on the ground surface while said male body is telescopically biased along a longitudinal length of said female body, each of said male and female bodies having corresponding apertures formed therein and equidistantly spaced apart, said telescopically locking means comprising an L-shaped locking pin removably positional into corresponding ones of said apertures aligned along a horizontal plane such that said male and female bodies remain statically fixed when said locking pin is inserted therethrough respectively, each of said locking pins including a J-shaped clasp slidably conjoined therewith.

5. The system of claim 4, wherein said lifter net section raising and lowering means comprises:

a plurality of guides directly coupled to top ends of said lifter posts respectively;

a plurality of elastic and deformably resilient fasteners directly coupled to said first and second lifter posts and said lifter net section respectively;

a hand-operable winch anchored to said first lifter post;

a flexible cable having a fixed longitudinal length tethered to said winch and one of said locking pins respectively;

wherein said cable travels upwardly along an inclined path and is directed over one of said guides whereat said cable turns to a horizontal path and is intercalated along said lifter net section, said cable traveling along an entire longitudinal length of said lifter net section and thereafter traveling downwardly along a declining path wherein said cable terminates at said one locking pin, said cable being anchored to a corresponding one of said J-shaped clasps such that a tension in said cable can be manually adjusted by said winch.

6. The system of claim 5, further comprising:

means for locking said locking pins to said lifter posts respectively, said locking pin locking means including a padlock positioned through one of said locking pins.

7. The system of claim 1, wherein said lifter net section comprises: one of the following bodies selected from the group including a mesh screen having coextensively shaped linear top and bottom edges spanning parallel to the existing net, said mesh screen having a netted body spanning between entire longitudinal lengths of said top and bottom edges such that the player can maintain a clear line of sight through said mesh screen;

a planar screen having coextensively shaped linear top and bottom edges spanning parallel to the existing net, said planar screen having a uniformly thick opaque body spanning between entire longitudinal lengths of said top and bottom edges such that the player cannot maintain a clear line of sight through said planar screen; and a linear headband having a longitudinal length spanning across the entire width of the tennis court, said headband being vertically spaced from the existing net such that a gap is formed between a top edge of the existing net and said headband respectively.

8. The system of claim 7, further comprising:

a hand-operable winding apparatus for winding and unwinding said headband during non-operating and operating conditions, said winding apparatus comprising an L-shaped handle, a linear central shaft threadably connected to said handle;

a pair of disc-shaped flanges journaled about said central shaft;

an auxiliary handle coupled directly to one of said disc-shaped flanges; and a spool concentrically fastened to said central shaft such that said spool rotates in sync with said central shaft;

wherein said handle is attached to said central shaft;

wherein said spool includes at least one latching pin affixed thereto for catching said headband during winding and unwinding operations.

9. The system of claim 1, further comprising:

a portable dolly for winding and storing said lifter net section during non-playing and transport conditions, said portable dolly comprising a base member including first and second pairs of casters rotatably secured thereto and equidistantly offset from a center of said base member such that said base member can be tilted about one of said first and second caster pairs during transport, an elongated and rectilinear spool having a bottom end directly connected to said base member and extending vertically upward therefrom, a turn-table disposed above said base member, first and second annular flanges seated above said turn-table and statically coupled to said spool, said first and second flanges being vertically stacked along a bottom end of said spool and further being rotatably and concentrically journaled about said spool, a third annular flange statically coupled to said spool and axially aligned from said first and second flanges; and a handle directly linked to said third flange, said handle protruding vertically upward from said third flange;

wherein said spool is rotatable in sync with said turn-table, said spool having at least one connector pin passing therethrough for latching onto said lifter net section during winding and unwinding operations.

10. A tennis net lifter system for assisting a player to practice various skills-improvement tests, said tennis net lifter system comprising:

first and second upstanding portable lifter posts positioned adjacent to stationary anchor posts of an existing tennis net assembly stretching across a width of a tennis court, said first and second lifter posts being registered parallel to said anchor posts and traveling along entire longitudinal lengths thereof respectively;

means for connecting said first and second lifter posts to said anchor posts such that said first and second lifter posts remain at a substantially stable and vertical positions during playing conditions;

means for telescopically locking said first and second lifter posts at selected heights above said anchor posts respectively;

a lifter net section operably coupled to said first and second lifter posts and positioned adjacent to an existing net of said tennis net assembly;

means for selectively raising and lowering said lifter net section along a vertical plane aligned parallel with said existing net such that the player can vertically and uniformly bias said lifter net section along the entire width of the tennis court, wherein said lifter net section raising and lowering means is spaced from the existing anchor posts;

wherein the existing net remains stationary while said lifter net section is selectively raised and lowered along the vertical plane; and a portable dolly for winding and storing said lifter net section during non-playing and transport conditions, said portable dolly comprising a base member including first and second pairs of casters rotatably secured thereto and equidistantly offset from a center of said base member such that said base member can be tilted about one of said first and second caster pairs during transport, an elongated and rectilinear spool having a bottom end directly connected to said base member and extending vertically upward therefrom, a turn-table disposed above said base member, first and second annular flanges seated above said turn-table and statically coupled to said spool, said first and second flanges being vertically stacked along a bottom end of said spool and further being rotatable and concentrically journaled about said spool, a third annular flange statically coupled to said spool and axially aligned from said first and second flange, and a handle directly linked to said third flange, said handle protruding vertically upward from said third flange;

wherein said spool is rotatable in sync with said turn-table, said spool having at least one connector pin passing therethrough for latching onto said lifter net section during winding and unwinding operations.

11. The system of claim 10, wherein said first and second lifter post connecting means comprises:

a plurality of bracket pairs having first and second arcuate regions seated about an outer periphery of said anchor posts and first and second lifter posts respectively, each of said bracket pairs being oppositely and diametrically opposed on opposite sides of said anchor posts and said first and second lifter posts respectively such that corresponding ones of said brackets pairs are directly fastened to each other and thereby maintain a static spatial relationship between said anchor posts and said first and second lifter posts respectively.

12. The system of claim 10, wherein said first and second lifter post connecting means comprises:

a plurality of interlocking brackets having male and female portions monolithically formed with said first and second lifter posts and anchor posts respectively, said male and female portions being statically and directly conjoined for maintaining said anchor posts and said first and second lifter posts equidistantly spaced along the vertical plane.

13. The system of claim 10, wherein each of said lifter posts comprises:

a male body and a female body slidably engageable with each other, said female body having a hollow center and remaining statically positioned directly on the ground surface while said male body is telescopically biased along a longitudinal length of said female body, each of said male and female bodies having corresponding apertures formed therein and equidistantly spaced apart, said telescopically locking means comprising an L-shaped locking pin removably positional into corresponding ones of said apertures aligned along a horizontal plane such that said male and female bodies remain statically fixed when said locking pin is inserted therethrough respectively, each of said locking pins including a J-shaped clasp slidably conjoined therewith.

14. The system of claim 13, wherein said lifter net section raising and lowering means comprises:

a plurality of guides directly coupled to top ends of said lifter posts respectively;

a plurality of elastic and deformably resilient fasteners directly coupled to said first and second lifter posts and said lifter net section respectively;

a hand-operable winch anchored to said first lifter post;

a flexible cable having a fixed longitudinal length tethered to said winch and one of said locking pins respectively;

wherein said cable travels upwardly along an inclined path and is directed over one of said guides whereat said cable turns to a horizontal path and is intercalated along said lifter net section, said cable traveling along an entire longitudinal length of said lifter net section and thereafter traveling downwardly along a declining path wherein said cable terminates at said one locking pin, said cable being anchored to a corresponding one of said J-shaped clasps such that a tension in said cable can be manually adjusted by said winch.

15. The system of claim 14, further comprising;

means for locking said locking pins to said lifter posts respectively, said locking pin locking means including a padlock positioned through one of said locking pins.

16. The system of claim 10, wherein said lifter net section comprises:

one of the following bodies selected from the group including a mesh screen having coextensively shaped linear top and bottom edges spanning parallel to the existing net, said mesh screen having a netted body spanning between entire longitudinal lengths of said top and bottom edges such that the player can maintain a clear line of sight through said mesh screen;

a planar screen having coextensively shaped linear top and bottom edges spanning parallel to the existing net, said planar screen having a uniformly thick opaque body spanning between entire longitudinal lengths of said top and bottom edges such that the player cannot maintain a clear line of sight through said planar screen; and a linear headband having a longitudinal length spanning across the entire width of the tennis court, said headband being vertically spaced from the existing net such that a gap is formed between a top edge of the existing net and said headband respectively.

17. The system of claim 16, further comprising:

a hand-operable winding apparatus for winding and unwinding said headband during non-operating and operating conditions, said winding apparatus comprising an L-shaped handle;

a linear central shaft connected to said handle;

a pair of disc-shaped flanges journaled about said central shaft;

an auxiliary handle coupled directly to one of said disc-shaped flanges; and a spool concentrically fastened to said central shaft such that said spool rotates in sync with said central shaft;

wherein said spool includes at least one latching pin affixed thereto for catching said headband during winding and unwinding operations.

18. The system of claim 10, further comprising:

a plurality of rectilinear rods vertically aligned along a longitudinal length of said lifter net section, each of said rods being orthogonally registered to a ground surface and being removably affixed to the existing net, each of said rods including a C-shaped locking clasp attached approximately midway a longitudinal length thereof, said C-shaped locking clasps being directly abutted with said lifter net section in such a manner that said rods can withstand lateral external forces from a tennis ball during playing conditions, said C-shaped clasps being slidably positional along the width of the existing tennis net such that said rods can be equidistantly juxtaposed side-by-side as desired by the player.

* * * * *